US008382226B2

(12) United States Patent
Satake

(10) Patent No.: US 8,382,226 B2
(45) Date of Patent: Feb. 26, 2013

(54) IMAGE FORMING SYSTEM

(75) Inventor: Kenichi Satake, Osaka (JP)

(73) Assignee: Kyocera Mita Corporation (JP)

( * ) Notice: Subject to any disclaimer, the term of this patent is extended or adjusted under 35 U.S.C. 154(b) by 275 days.

(21) Appl. No.: 12/839,514

(22) Filed: Jul. 20, 2010

(65) Prior Publication Data

US 2011/0018923 A1 Jan. 27, 2011

(30) Foreign Application Priority Data

Jul. 27, 2009 (JP) ..... 2009-174576

(51) Int. Cl.
*B41J 29/38* (2006.01)

(52) U.S. Cl. ..... 347/12

(58) Field of Classification Search ..... None
See application file for complete search history.

(56) References Cited

U.S. PATENT DOCUMENTS

| | | | | |
|---|---|---|---|---|
| 7,278,700 | B2 * | 10/2007 | Yamaguchi et al. | 347/13 |
| 2002/0024557 | A1 * | 2/2002 | Matsumoto et al. | 347/42 |
| 2011/0012949 | A1 * | 1/2011 | Enge | 347/12 |

FOREIGN PATENT DOCUMENTS

| | | |
|---|---|---|
| JP | 6-255098 | 9/1994 |

* cited by examiner

*Primary Examiner* — Stephen Meier
*Assistant Examiner* — Tracey McMillion
(74) *Attorney, Agent, or Firm* — Gerald E. Hespos; Michael J. Porco; Matthew Hespos

(57) ABSTRACT

An image forming system configured to eject ink onto a sheet conveyed in a first direction including a first head including a plurality of first ejection ports configured to eject the ink; a second head including a plurality of second ejection ports configured to eject the ink; an input part configured to be input ejection port information on the plurality of first ejection ports and the plurality of second ejection ports; and a controller configured to control ejection of the ink from the first ejection ports and the second ejection ports based on the ejection port information.

10 Claims, 11 Drawing Sheets

FIG.4A

| EJECTION PORT NUMBER | $H_{L1}$ | $H_{L2}$ | ..... | $H_{L10}$ | $H_{L11}$ | $H_{L12}$ |
|---|---|---|---|---|---|---|
| TYPE | ACTIVE | ACTIVE | ..... | FIRST REFERENCE EJECTION PORT | INACTIVE | INACTIVE |

FIG.4B

| EJECTION PORT NUMBER | $H_{R1}$ | $H_{R2}$ | $H_{R3}$ | ..... | $H_{R11}$ | $H_{R12}$ |
|---|---|---|---|---|---|---|
| TYPE | SECOND REFERENCE EJECTION PORT | ACTIVE | ACTIVE | ..... | ACTIVE | ACTIVE |

IMAGE FORMING SYSTEM

BACKGROUND OF THE INVENTION

1. Field of the Invention

The present disclosure relates to an image forming system including inkjet heads configured to eject ink to a sheet to form an image.

2. Description of the Related Art

A serial recording system or a line head recording system is applied to most of image forming apparatuses with printing functions for forming images using ink (printers, multi-functional peripherals, etc.). The serial recording system includes a recording head configured to scan a sheet. The line head recording system includes a fixed head unit.

The head unit used for the image forming apparatus with the line head recording system ejects the ink onto a conveyed sheet to effect a recording operation. The head unit includes a plurality of ejection ports arranged in accordance with the width dimension of the sheet.

Many types of image forming apparatuses are configured to effect printing operation on various sizes of sheets. The length of the fixed recording head mentioned above is set in accordance with the width of the largest sheet. In many cases, the head unit includes a plurality of connected heads in order to ensure a printing area large enough for the largest sheet. The head unit with the plurality of heads is produced relatively easily.

The alignment of the ejection ports in the head unit in a direction substantially perpendicular to the sheet conveying direction significantly affects qualities of an image to be formed. The heads therefore have to be connected carefully. An excessively wide space between the ejection ports at a connection portion of the heads causes a defective area, where the ink does not adhere in an image formed on the sheet. The defective area where the ink does not adhere to the image looks like a stripe extending along the conveying direction of the sheet. An excessively narrow space between the ejection ports at the connection portion of the heads causes a partial or overall overlap of dots of the ink ejected from the ejection ports at the connection portion. The overlapped dots results in a deeper printing area on the formed image. As a result, the highly deeper printing area looks like an outstanding stripe on the sheet. Therefore, the distance between the ejection ports at the connection portion of the heads has to be determined very carefully.

A specific head unit includes a pair of heads partially overlapped so as to align a pair of ejection ports in the sheet conveying direction in the connected part between the heads. The ejection of the ink from the pair of ejection ports is switched selectively.

The heads including the pair of ejection ports mentioned above are positioned on a supporting board. The heads has to be mounted onto the supporting board very accurately in order to prevent the formation of the stripe on the sheet by selectively ejecting the ink from the pair of ejection ports.

In order to check if the heads are mounted onto an appropriate position or not, a user forms an image on the sheet by ejecting the ink from the heads mounted onto the supporting board. The user then measures a relative space between dots of the ink forming the image through microscopic observation. When the heads are mounted onto inappropriate positions, the user displaces the heads on the supporting board and checks the space again. Therefore, the user is required to perform a complicated adjustment work for positioning the heads according to the conventional manner.

SUMMARY OF THE INVENTION

The present disclosure provides an image forming system including heads configured to efficiently form a high-quality image.

An image forming system configured to eject ink onto a sheet conveyed in a first direction according to one aspect of the present disclosure includes a first head including a plurality of first ejection ports configured to eject the ink; a second head including a plurality of second ejection ports configured to eject the ink; an input part configured to be input ejection port information on the plurality of first ejection ports and the plurality of second ejection ports; and a controller configured to control ejection of the ink from the first ejection ports and the second ejection ports based on the ejection port information, wherein the plurality of first ejection ports and the plurality of second ejection ports are aligned in a second direction intersecting with the first direction, the second head in a shifted position in the first direction with respect to the first head is shifted in the second direction with respect to the first head so as to form an overlapped area in which a first printing area defined by the plurality of first ejection ports and a second printing area defined by the plurality of second ejection ports overlap with each other in the second direction, the plurality of first ejection ports include a first reference ejection port defining an edge of the overlapped area, the plurality of second ejection ports include a second reference ejection port defining an edge of the overlapped area, the ejection port information includes information on the first reference ejection port and the second reference ejection port, and the controller selectively switches between ejection of the ink from the first reference ejection port and ejection of the ink from the second reference ejection port.

BRIEF DESCRIPTION OF THE DRAWINGS

FIG. 4A is a diagram showing an ejection table stored in an ejection table storage of the image forming system shown in FIG. 3;

FIG. 4B is a diagram showing the ejection table stored in the ejection table storage of the image forming system shown in FIG. 3;

DETAILED DESCRIPTION OF THE PREFERRED EMBODIMENTS

An embodiment is described hereinafter with reference to the drawings. It should be noted that the terms describing directions such as "upper," "lower," "left" and "right" are used in the following description for the purpose of clarification of the description and therefore should not be interpreted in any limited manner. The term "sheet" used in the following description means copy paper, tracing paper, cardboard, OHP sheet and other paper on which images may be formed.

(Mechanical Configuration of Image Forming Apparatus)

Figure 1:
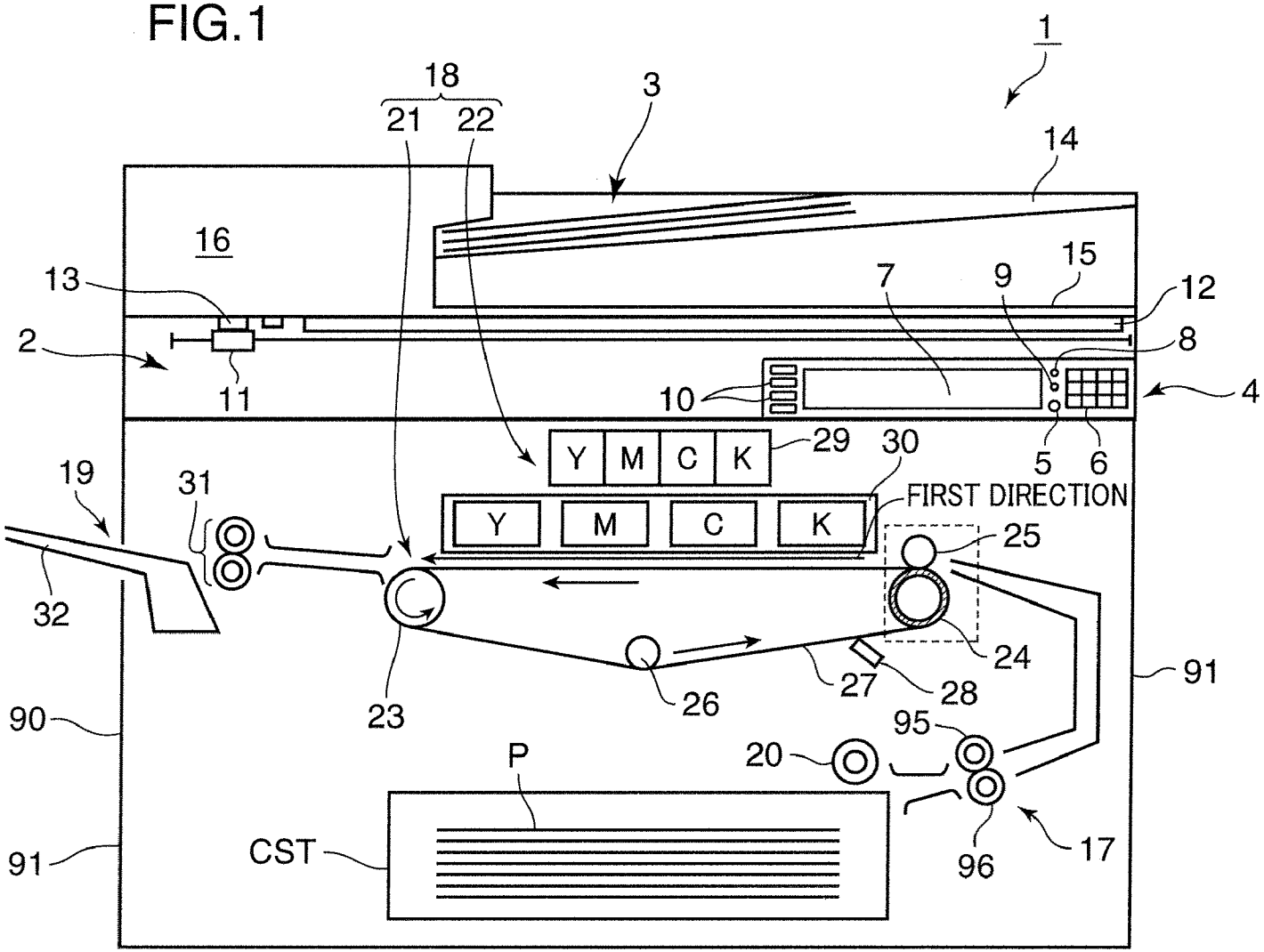
FIG. 1 is a schematic drawing showing a copy machine including an image forming system according to an embodiment.

FIG. 1 mainly shows an internal configuration of an image forming apparatus according to an embodiment. It should be noted that the image forming apparatus shown in FIG. 1 is a multi functional peripheral. Alternatively, the image forming apparatus may be, for example, a printer, a facsimile machine or a copy machine.

An image forming apparatus 1 includes a housing 90 configured to accommodate therein various equipments for ejecting ink to form an image on a sheet P and a document feeder 3 mounted onto the housing 90. The image forming apparatus 1 further includes a document reader 2 disposed in an upper internal space of the housing 90. The document reader 2 is configured to read an image on a document sent from the document feeder 3 to an upper surface of the document reader 2.

The image forming apparatus 1 further includes a sheet feeder 17 disposed in a lower internal space of the housing 90, an image forming part 18 above the sheet feeder 17 and a sheet discharger 19 on the downstream side in a sheet moving direction (on the left side of the image forming apparatus 1 in FIG. 1). The image forming part 18 uses ink to form an image on the sheet P conveyed by the sheet feeder 17. The sheet discharger 19 discharges the sheet P with the image formed thereon to the outside of the housing 90.

The image forming apparatus 1 also includes an operating part 4 to which operation information for the image forming apparatus 1 is input. The operating part 4 is mounted to a front plate of the housing 90. The operating part 4 includes a start key 5 and numeric keys 6. A user may use the start key 5 to input an instruction for the image forming apparatus 1 to start printing. The user may also use the numeric keys 6 to, for example, input the number of prints. The operating part 4 also includes a display part 7 configured to display information used for operating the image forming apparatus 1. The display part 7 may show the user, for example, operation guide information for executing various copy operations. The display part 7 may be preferably a liquid crystal display with a touch panel function. The user may input various settings to the image forming apparatus 1 by using the touch panel function. The operating part 4 includes a reset key 8 for canceling the settings input through the display part 7, a stop key 9 for stopping a print operation in execution and function switch keys 10 for switching various functions provided to the image forming apparatus 1.

The document reader 2 includes a scanner part 11 with an exposure lamp, a document board 12, a slit 13 through which the document may be read, both of which made of a transparent member such as a glass plate, a CCD (Charge Coupled Device) sensor (not shown) and the like. The scanner part 11 is reciprocally moved by a driver (not shown) between sideboards 91 on the left and right of the front plate of the housing 90 to which the operating part 4 is mounted.

When the user places the document on the document board 12 in order to make a copy of the document, the scanner part 11 under the document board 12 moves right and left along the surface of the document to scan the image of the document, and then sends the document image to the CCD sensor. The image data obtained by the CCD sensor is subjected to A/D conversion processing or the like by the document reader 2, which then outputs the image data to a controller 35 described hereinafter.

The scanner part 11 moves to a position below the slit 13 when the user feeds the document using the document feeder 3. Thereafter, the CCD sensor with the scanner part 11 reads the image of the document through the slit 13 in synchronization with a document feeding operation performed by the document feeder 3 to generate the image data. The image data is subjected to the A/D conversion process or the like by the document reader 2 and then output to the controller 35.

The document feeder 3 includes a document placing part 14 on which the document is placed, a document discharger 15 configured to discharge the document after the image reading by the scanner part 11 and a document feeding mechanism 16 configured to feed the document from the document placing part 14 to the document discharger 15. The document feeding mechanism 16 including conveyance elements (not shown) such as paper feeding rollers and conveying rollers configured to convey the document makes the document pass through on the slit 13. Optionally the document feeding mechanism 16 may include a reversing mechanism (not shown) configured to reverse the document. The reversed sheet P is moved on the slit 13 again by the conveying elements aforementioned. Consequently, the images on both sides of the document are read by the CCD sensor through the document reading slit 13 and the scanner part 11.

The document feeder 3 is rotatably connected to a rear plate opposite the front plate of the housing 90 to which the operating part 4 is mounted. The user may lift up a front part of the document feeder 3 to put the document (for example, an opened book) on an upper surface of the document board 12.

The sheet feeder 17 includes a paper feeding cassette CST. A stack of sheets P is placed in the paper feeding cassette CST. The sheet feeder 17 includes a pickup roller 20 above the paper feeding cassette CST. The paper feeding cassette CST includes a biasing mechanism (not shown) configured to push up a leading edge of the sheet P toward the pickup roller 20. The pickup roller 20 then sends the sheet P pushed up by the biasing mechanism to the outside of the paper feeding cassette CST.

The sheet feeder 17 includes a paper feeding roller 95 and retard roller 96 which are arranged after the pickup roller 20 in the paper conveying direction. The pickup roller 20 sends the sheet P between the paper feeding roller 95 and the retard roller 96. The paper feeding roller 95 rotates in a direction to send the sheet P from the pickup roller 20 further downstream in the sheet moving direction. The retard roller 96 rotates in a direction to return the sheet P sent by the pickup roller 20 to the paper feeding cassette CST. The sheet P into direct contact with the paper feeding roller 95 among the plurality of sheets P sent by the pickup roller 20 is further conveyed downstream while the other sheets P are returned to the paper feeding cassette CST by the retard roller 96. Thus, the paper feeding roller 95 and the retard roller 96 work together to convey the sheet P downstream in the sheet moving direction, one by one, to the image forming part 18.

The image forming part 18 includes a sheet conveyor 21 configured to convey the sheet P fed by the sheet feeder 17 toward the sheet discharger 19, and an ink ejector 22 configured to eject the ink to the sheet P conveyed by the sheet conveyor 21. In the present embodiment, the moving direction of the sheet P conveyed by the sheet conveyor 21 (i.e., the direction toward the sheet discharger 19) is exemplified as a first direction. In addition, the sheet conveyor 21 is exemplified as a conveyor configured to convey the sheet P in the first direction.

The sheet conveyor 21 includes a driven roller 23, an idle roller 24, an attraction roller 25, a tension roller 26, a conveying belt 27 and a blade 28. The conveying belt 27 wrapped around the driven roller 23, the idle roller 24 and the tension roller 26 is an endless belt with a surface layer made of, for example, chloroprene rubber.

The driven roller 23 is rotated and driven (see the counterclockwise arrow in FIG. 1) by a motor (not shown). The conveying belt 27 runs as the driven roller 23 rotates. The idle roller 24 and the tension roller 26 rotate as the conveying belt 27 runs. The tension roller 26 is mounted so as to maintain the tension of the conveying belt 27 for stabilizing the tracking of the conveying belt 27.

The attraction roller 25 is disposed so as to sandwich the conveying belt 27 cooperatively with the idle roller 24. The attraction roller 25 charges the conveying belt 27. As a result, the sheet P fed by the sheet feeder 17 are electrostatically attracted to the conveying belt 27. Consequently, the sheet conveyor 21 conveys the sheet P toward the sheet discharger 19 mounted to the left sideboard 91 of the housing 90 with attracting the sheet P fed by the sheet feeder 17.

The blade 28 is mounted so as to come into slidable contact with a conveying surface of the conveying belt 27 running from the driven roller 23 to the idle roller 24. The blade 28 scrapes off and removes the ink or other extraneous objects adhering to the conveying surface of the conveying belt 27.

The ink ejector 22 includes an ink tank 29 configured to accommodate the ink, and a head unit 30 configured to eject the ink supplied from the ink tank 29 toward the sheet P conveyed in the first direction by the sheet conveyor 21 in accordance with the image data generated by the controller 35 as described hereinafter. In the present embodiment, the internal space of the ink tank 29 is divided into a plurality of reservoir chambers for separately accommodating yellow ink, magenta ink, cyan ink and black ink.

The sheet discharger 19 includes a pair of discharging rollers 31 configured to discharge the sheet P conveyed by the sheet conveyor 21 with sandwiching the sheet P therebetween to the outside of the housing 90, and a tray 32 configured to receive the sheet P discharged by the pair of discharging rollers 31.

(Mechanical Structure of Head Unit)

Figure 2:
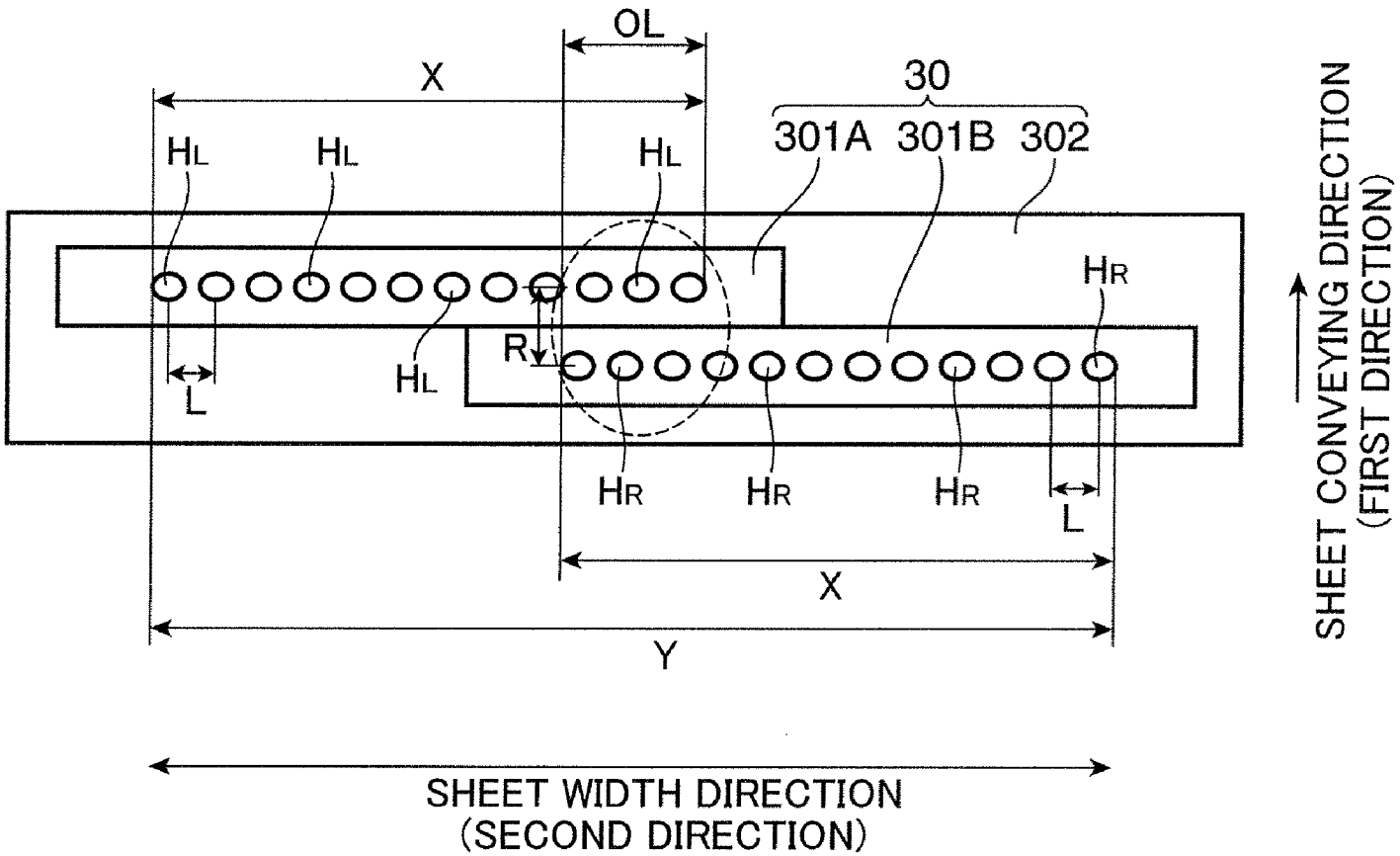
FIG. 2 is a schematic bottom view of a head unit used for the copy machine shown in FIG. 1.

FIG. 2 is a bottom view schematically showing the head unit 30. The head unit 30 is described with reference to FIGS. 1 and 2.

As described above, the conveying direction of the sheet P is exemplified as the first direction. A width direction of the sheet P perpendicular to the conveying direction of the sheet P is exemplified as a second direction. The head unit 30, which is controlled by the controller 35 described hereinafter, ejects the ink intermittently in accordance with the image data generated by the controller 35. The head unit 30 ejecting the ink in synchronization with the conveyance of the sheet P forms ink lines extending in the width direction of the sheet P every time the ink is ejected on the sheet P. As a result, a 2D image according to the image data is formed on the sheet P.

The head unit 30 includes a first head 301A in which a plurality of first ejection ports $H_L$ for ejecting the ink are formed, a second head 301B in which a plurality of second ejection ports $H_R$ for ejecting the ink are formed, and a support 302 configured to support the first head 301A and the second head 301B. In the present embodiment, an image is formed on the sheet P by ink ejection from the first head 301A and the second head 301B. Alternatively, the image may be formed on the sheet P by ink ejection from three or more heads.

The plurality of first ejection ports $H_L$ formed in the first head 301A are aligned in the second direction. Similarly, the plurality of second ejection ports $H_R$ formed in the second head 301B are aligned in the second direction. A pitch L of the plurality of second ejection ports $H_R$ is substantially equal to a pitch L of the plurality of first ejection ports $H_L$. The length of the pitch L preferably depends on predetermined resolution of an image. In the following description, the row of the plurality of first ejection ports $H_L$ and the row of the plurality of second ejection ports $H_R$ are each referred to as "ejection port row."

The first head 301A is mounted on the support 302 such that the ejection port row in the first head 301A is positioned downstream in the sheet moving direction by a shift amount R with respect to the ejection port row in the second head 301B. In the present embodiment, the ejection port row in the first head 301A defines a first printing area with a predetermined width dimension. Similarly, the ejection port row in the second head 301B defines a second printing area with a predetermined width dimension. The second head 301B is overlapped with the first head 301A in the second direction and mounted on the support 302 so as to form an overlapped area where the first printing area and the second printing area overlap with each other. In FIG. 2 the width dimension of the overlapped area is represented by a symbol "OL." Preferably, the first head 301A and the second head 301B are mounted on the support 302 such that a part including a right end part of the first head 301A and a part including a left end part of the second head 301B are positioned adjacent to each other in the first direction, as shown by the dotted line in FIG. 2. As a result, the first ejection ports $H_L$, which are formed in the part including the right end part of the first head 301A, and the second ejection ports $H_R$, which are formed in the part including the left end part of the second head 301B, are positioned adjacent to each other in the first direction.

In the following description, the width dimension of the widest sheet P on which an image may be formed by the image forming apparatus 1 is referred to as "maximum sheet width." In the present embodiment, the length of the ejection port row of the first head 301A defining the first printing area is substantially equal to the length of the ejection port row of the second head 301B defining the second printing area. The length of the ejection port row of the first head 301A and the length of the ejection port row of the second head 301B, each of which is represented by "X," is set to be shorter than the maximum sheet width. The width dimension of an ejection area defined by the ejection port row of the first head 301A and the ejection port row of the second head 301B (the dimension in the second direction) "Y" is preferably set to be larger than the maximum sheet width.

As described above, the ejection port row of the first head 301A is disposed downstream in the first direction by the shift amount R with respect to the ejection port row of the second head 301B. The controller 35, described hereinafter, controls the head unit 30 in consideration of the shift amount R and the speed of conveying the sheet P, such that the timing of the ink ejection from the first head 301A delays from the timing of the ink ejection from the second head 301B. As a result, the lines formed on the sheet P by the ink ejected from the first head 301A and the lines formed on the sheet P by the ink ejected from the second head 301B are aligned in the second direction.

The ink ejection from the first head 301A and the second head 301B may be accomplished with a known structure. For example, the head unit 30 includes piezoelectric elements provided correspondingly to the first ejection ports $H_L$ and the second ejection ports $H_R$, pulse applicators configured to apply a driving pulse to each piezoelectric element, vibrating plates to which the deformation of piezoelectric elements caused by the application of the driving pulse are transmitted, and a compression chambers of which internal space are subjected to pressure resulting from the deformation of the vibrating plates. The ink compressed due to a decrease in the internal volume of the compression chambers is ejected in the form of an ink droplet onto the sheet P from the ejection ports (the first ejection ports $H_L$ or the second ejection ports $H_R$) connected to the compression chambers.

(Electrical Structure of Image Forming System)

Figure 3:
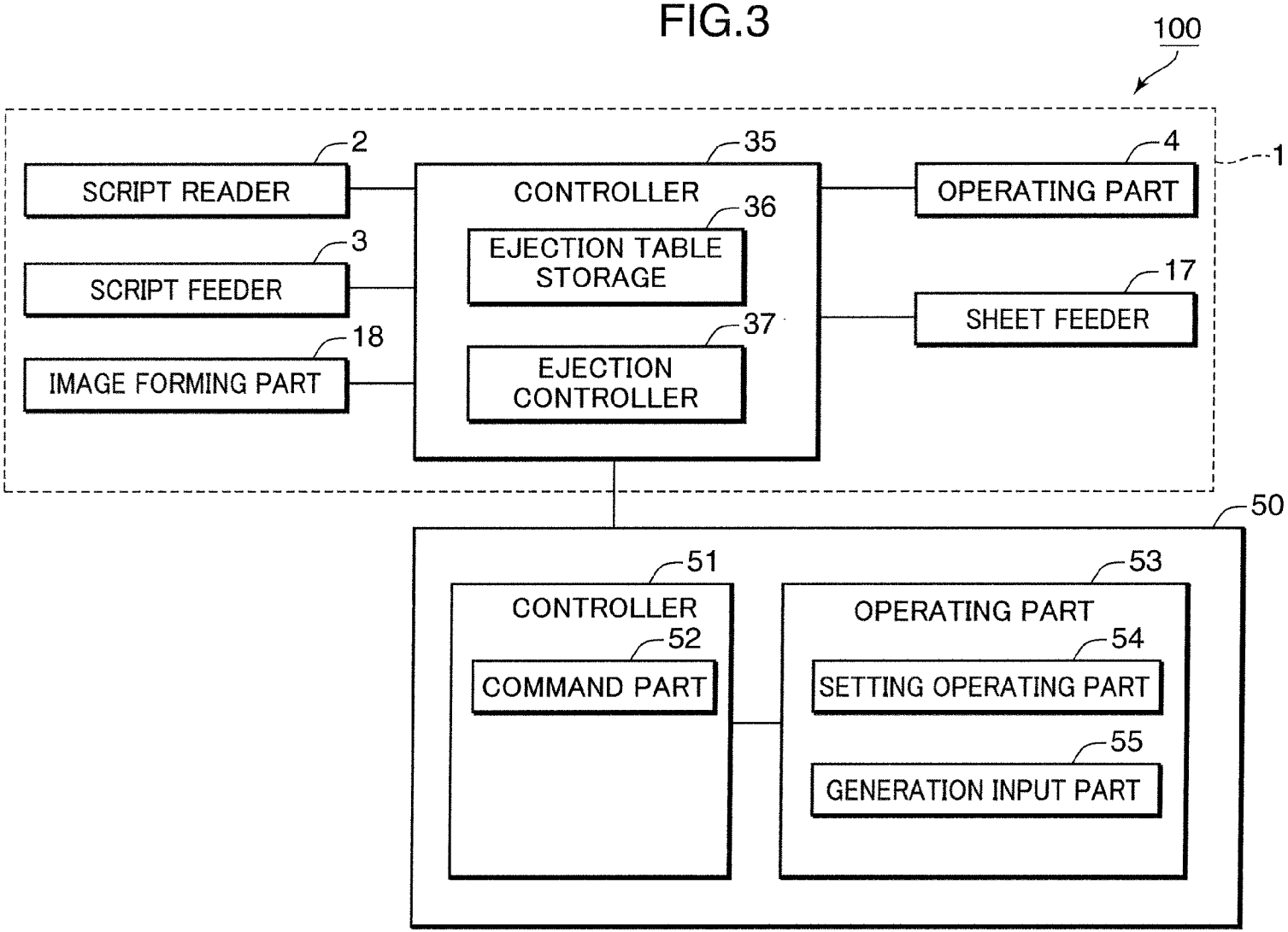
FIG. 3 is a block diagram showing an electrical configuration of the image forming system according to the embodiment.

FIG. 3 is a block diagram schematically showing an electrical configuration of the image forming system 100. The electrical configuration of the image forming system 100 is described with reference to FIGS. 1 to 3. It should be noted that the same reference numerals are applied to the same elements as those shown in FIG. 1. The descriptions of the same elements are omitted for clarification of the description.

The image forming system 100 includes the image forming apparatus 1 and a personal computer 50 communicating with the image forming apparatus 1. The image forming apparatus 1 includes the controller 35 as described above. The controller includes, for example, a CPU (Central Processing Unit) configured to execute predetermined arithmetic processing, a ROM (Read Only Memory) in which predetermined control programs are stored, a RAM (Random Access Memory) configured to store data temporarily, and various other elements required for processing signals sent from the personal computer. The document reader 2, the document feeder 3, the image forming part 18, the operating part 4 and the sheet feeder 17 are electrically connected to the controller 35. The controller 35 further includes an ejection table storage 36 and ejection controller 37. In the present embodiment the ejection table storage 36 is exemplified as a storage configured to store ejection port information.

An ejection table is stored in the ejection table storage 36 in advance. The ejection table contains tabular information indicating whether the ejection ports $H_L$ and $H_R$ formed in the first head 301A and the second head 301B respectively is the ejection ports to be used in image formation (to be referred to as "active ejection ports" hereinafter) or the ejection ports not to be used in image formation (to be referred to as "inactive ejection ports" hereinafter).

Figure 5:
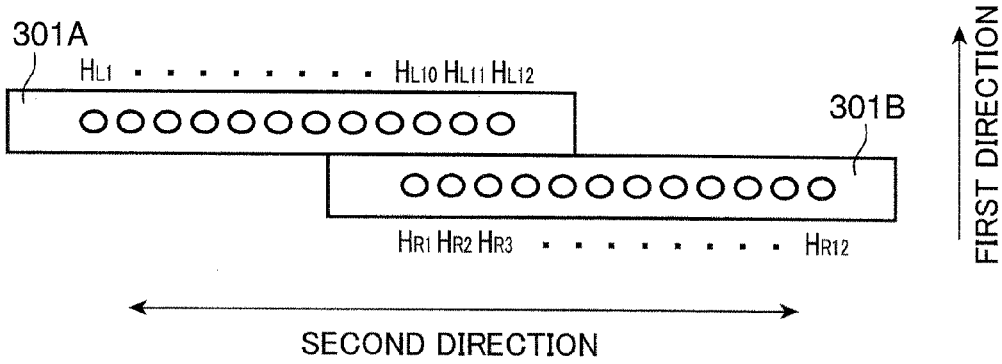
FIG. 5 schematically shows a first head and second head of the head unit shown in FIG. 2.

FIG. 4A shows the ejection table for the first ejection ports $H_L$. FIG. 4B shows the ejection table for the second ejection ports $H_R$. FIG. 5 is a bottom view schematically showing the first head 301A and the second head 301B. The first ejection ports $H_L$ shown in FIG. 5 are applied with reference numerals $H_{L1}$ to $H_{L12}$ in accordance with the ejection table shown in FIG. 4A. Similarly, the second ejection ports $H_R$ shown in FIG. 5 are applied with reference numerals $H_{R1}$ to $H_{R12}$ in accordance with the ejection table shown in FIG. 4B. The information indicating "active" (the ink is ejected)/"inactive" (the ink is not ejected) are allocated to the first ejection ports $H_{L1}$ to $H_{L12}$ as well as to the second ejection ports $H_{R1}$ to $H_{R12}$ by using the ejection port tables. The ejection tables are preferably created so as to be conformed with the manufacture of the head unit 30. Creation of the ejection tables is described with reference to FIGS. 4A, 4B and 5.

A manufacturer initially mounts the first head 301A and the second head 301B to the support 302. It may not be necessary for the manufacturer to carefully mount the first head 301A and the second head 301B to the support 302. The manufacturer may mount the first head 301A and the second head 301B to the support 302 such that some of the first ejection ports $H_L$ among the first ejection ports $H_{L1}$ to $H_{L12}$ are positioned adjacent to some of the second ejection ports $H_R$ among the second ejection ports $H_{R1}$ to $H_{R12}$ in the first direction.

Figure 6A:
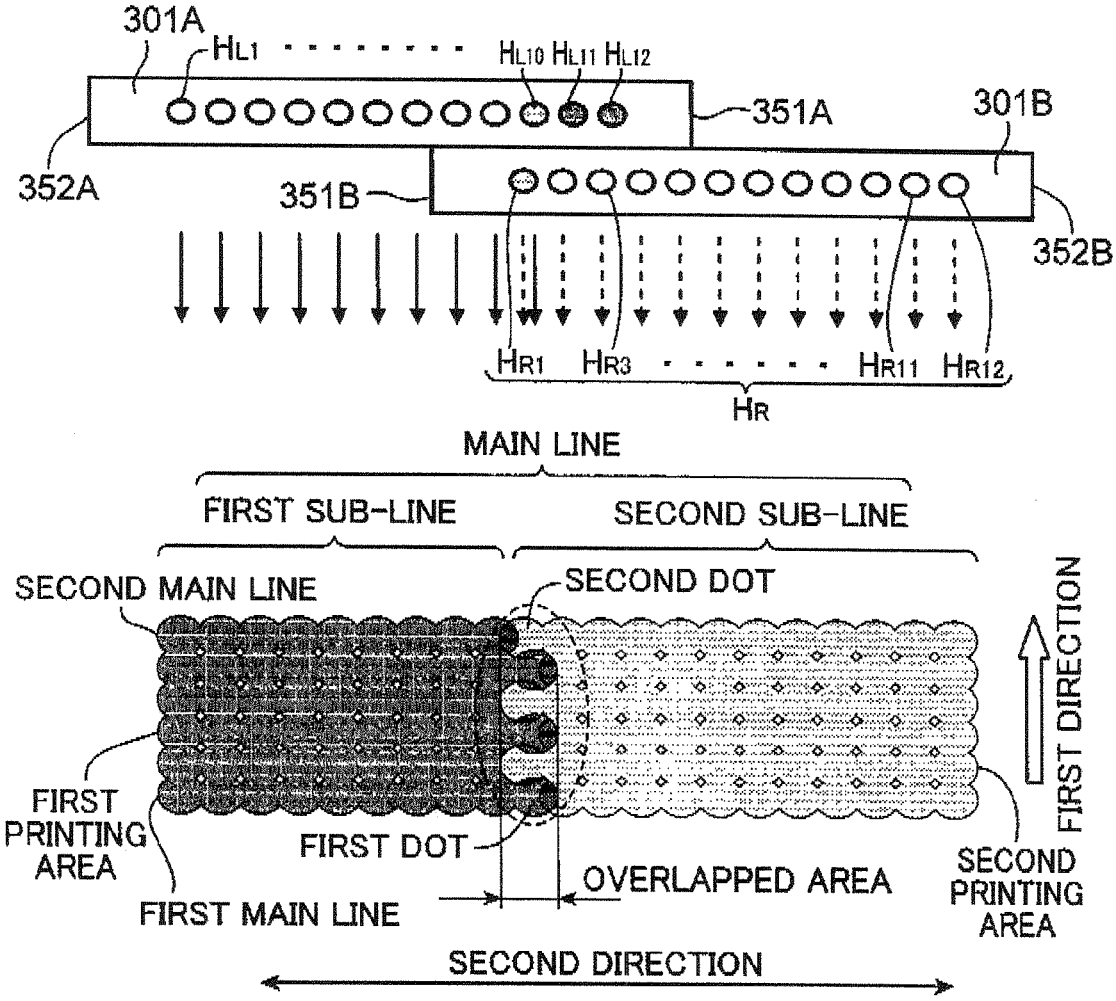
FIG. 6A exemplifies ink ejection from the first head and the second head shown in FIG. 5.
Figure 6B:
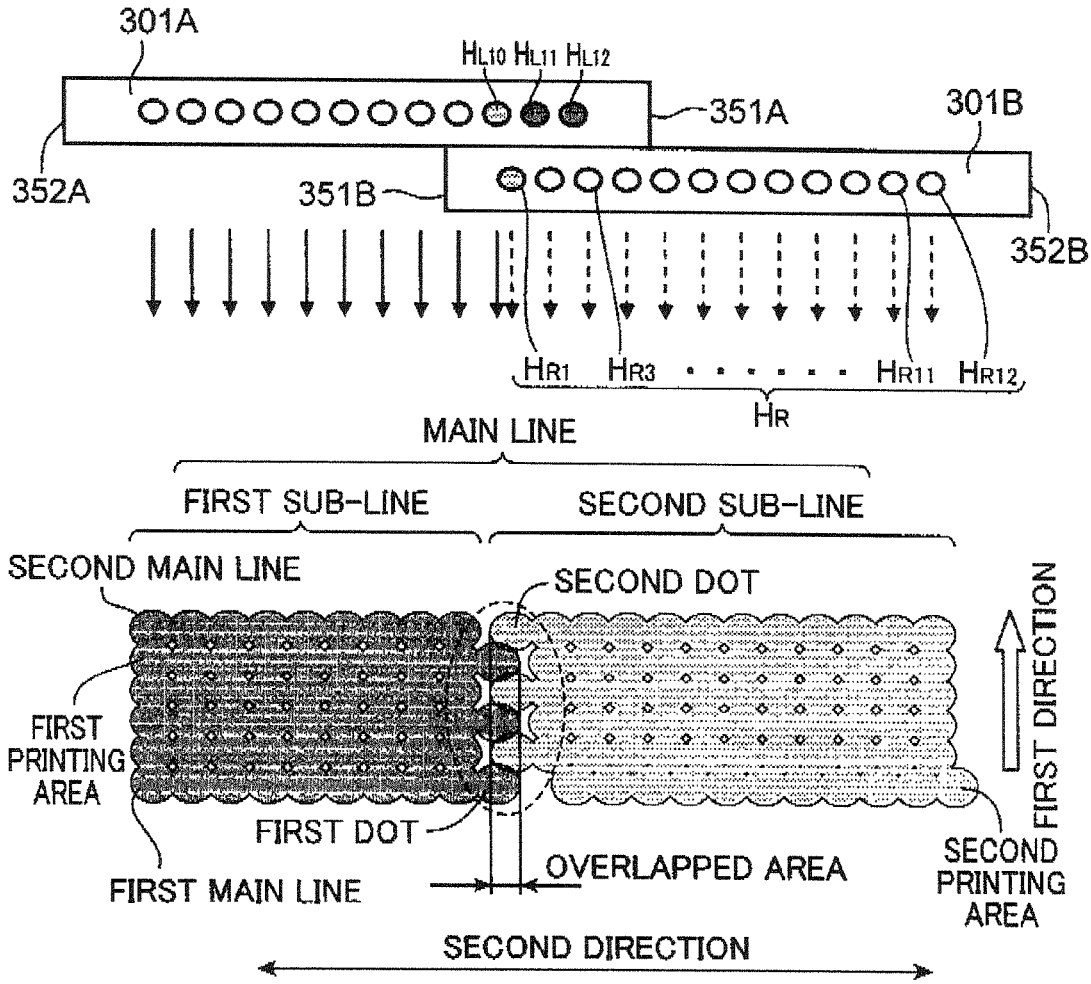
FIG. 6B exemplifies ink ejection from the first head and the second head shown in FIG. 5.

FIGS. 6A and 6B are bottom views showing the first head 301A and the second head 301B mounted on the support 302. The creation of the ejection tables is further described with reference to FIGS. 4A to 6B.

In the present embodiment, the manufacturer may less accurately mount the first head 301A and the second head 301B onto the support 302. Therefore, the number of pairs of first ejection ports $H_L$ and second ejection ports $H_R$ adjacent to each other in the first direction may be different every time the first head 301A and the second head 301B are installed onto the support 302. Furthermore, the first ejection ports $H_L$ and second ejection ports $H_R$ adjacent to each other in the first direction may be aligned along the first direction. Alternatively, the first ejection ports $H_L$ and second ejection ports $H_R$ adjacent to each other in the first direction may be shifted in the second direction.

The first ejection port $H_L$ and the second ejection ports $H_R$ adjacent to each other in the first direction eject the ink to the same position or to relatively closer positions in the second direction. Therefore, if the first ejection port $H_L$ and second ejection port $H_R$ adjacent to each other in the first direction are both active, the dot formed on the sheet P by the ink ejected from the first head 301A completely or partially overlaps with the dot formed on the sheet P by the ink ejected from the second head 301B.

In the present embodiment, the ejection tables are created such that the dots formed on the sheet P are less likely to overlap. In the present embodiment, the plurality of first ejection ports $H_L$ include a first reference ejection port configured to form an edge of the overlapped area composed of the first printing area defined by the first head 301A and the second printing area defined by the second head 301B. Similarly, the plurality of second ejection ports $H_R$ include a second reference ejection port configured to form an edge of the overlapped area composed of the first printing area defined by the first head 301A and the second printing area defined by the second head 301B.

The first head 301A includes an end part 351A overlapping with the second head 301B and an end part 352A opposite the end part 351A. The second head 301B includes an end part 351B overlapping with the first head 301A and an end part 352B opposite the end part 351B. As shown in FIGS. 6A and 6B, the reference numerals $H_{L1}$ to $H_{L12}$ are sequentially allocated to the plurality of first ejection ports $H_L$, starting from the end part 352A to the end part 351A. Similarly, the reference numerals $H_{R1}$ to $H_{R12}$ are sequentially allocated to the plurality of second ejection ports $H_R$, starting from the end part 351B to the end part 352B.

The second reference ejection port is the second ejection port $H_R$ closest to the end part 351B (the ejection port represented by the reference numeral $H_{R1}$ in FIGS. 6A and 6B) among the plurality of second ejection ports $H_R$. In addition, the first reference ejection port is the ejection port closest to the second ejection port $H_{R1}$ defined as the second reference ejection port (the ejection port represented by the reference numeral $H_{L10}$ in FIGS. 6A and 6B) among the plurality of first ejection ports $H_L$. It should be noted that among the plurality of first ejection ports $H_L$, the first ejection port $H_L$ closest to the end part 351A (the ejection port represented by the reference numeral $H_{L12}$ in FIGS. 6A and 6B) may be defined as the first reference ejection port, and that among the plurality of second ejection ports $H_R$, the ejection port closest to the first ejection port $H_{L12}$ (the ejection port represented by the reference numeral $H_{R3}$ in FIGS. 6A and 6B) defined as the first reference ejection port may be determined as the second reference ejection port.

The manufacturer sets the first ejection ports $H_{L11}$, $H_{L12}$ between the first ejection port $H_{L10}$ defined as the first reference ejection port and the end part 351A as the inactive ejection ports. The first ejection ports $H_{L11}$, $H_{L12}$ set as the inactive ejection ports are not used for image formation. Therefore, the edge of the overlapped area is defined by the first ejection port $H_{L10}$ determined as the first reference ejection port. The manufacturer sets the first ejection ports $H_{L1}$ to $H_{L10}$ as the active ejection ports, excluding the first ejection ports $H_{L11}$, $H_{L12}$ which are set as the inactive ejection ports. The manufacturer also sets all of the second ejection ports $H_{R1}$ to $H_{R12}$ as the active ejection ports. The first ejection ports $H_{L1}$ to $H_{L10}$ and the second ejection ports $H_{R1}$ to $H_{R12}$ set as the active ejection ports are used for image formation. Therefore, during the image formation, the ink is ejected appropriately in accordance with the image data from the first ejection ports $H_{L1}$ to $H_{L10}$ and the second ejection ports $H_{R1}$ to $H_{R12}$ set as the active ejection ports.

The controller 35 preferably controls the head unit 30 such that the ink from the ejection port $H_{L10}$ defined as the first reference ejection port and the ink from the second ejection port $H_{R1}$ defined as the second reference ejection port are ejected alternately every time the ink line is formed. The controller 35 may selectively switch between the ink ejection from the first ejection port $H_{L10}$ and the ink ejection from the second ejection port $H_{R1}$ whenever a plurality of lines are formed if necessary. Switch between the ink ejection from the first reference ejection port $H_{L10}$ and the ink ejection from the second reference ejection port $H_{R1}$ may be appropriately determined according to the quality of the image to be formed. The effects resulting from the switching operation between the ink ejection from the ejection port $H_{L10}$ and the ink ejection from the ejection port $H_{R1}$ are described hereinbelow.

Figure 7:
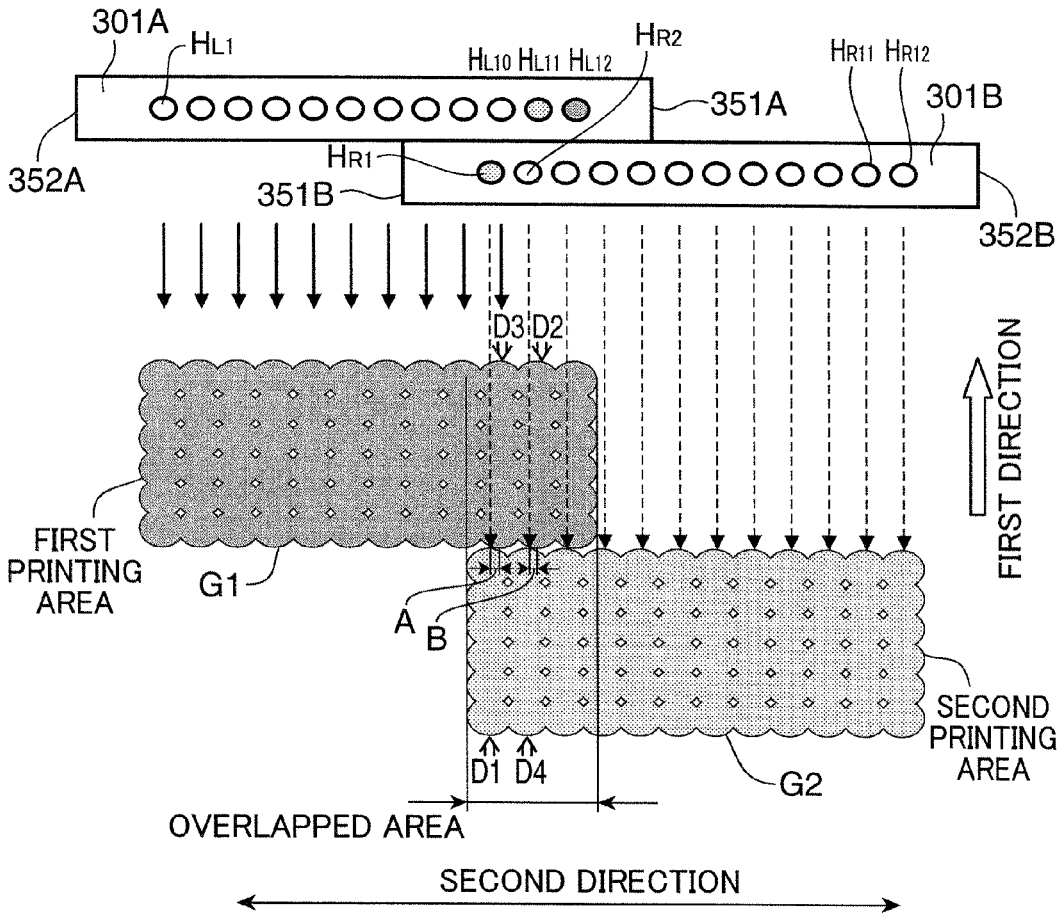
FIG. 7 shows a test image formed with the first head and the second head shown in FIG. 5.

FIG. 7 is a schematic diagram describing a method for setting the first reference ejection port, the inactive ejection ports and the active ejection ports. The method for setting the first reference ejection port, the inactive ejection ports and the active ejection ports is described with reference to FIG. 7.

As described above, the manufacturer mounts the first head 301A and the second head 301B onto the support 302 such that the right end part of the first printing area defined by the first head 301A and the left end part of the second printing area defined by the second head 301B overlap with each other (see FIG. 2). The manufacturer then conveys the sheet P in the first direction while ejecting the ink from the plurality of first ejection ports $H_{L1}$ to $H_{L12}$ until a predetermined number of lines is formed. In the following description, a line in the second direction that is formed with dots of the ink ejected from the plurality of first ejection ports $H_{L1}$ to $H_{L12}$ is called "first sub-line." A plurality of first sub-lines are aligned in the first direction as the sheet P is conveyed in the first direction, whereby a first test image G1 is formed. The first test image G1 including six first sub-lines is formed in FIG. 7. In the first test image G1, the dots of ink ejected from the plurality of first ejection ports $H_{L1}$ to $H_{L12}$ are arranged into a matrix.

After forming the first test image G1, the manufacturer further conveys the sheet P in the first direction while ejecting the ink from the plurality of second ejection ports $H_{R1}$ to $H_{R12}$ until a predetermined number of lines are formed. In the following description, a line in the second direction that is formed with dots of the ink ejected from the plurality of second ejection ports $H_{R1}$ to $H_{R12}$ is called "second sub-line." A plurality of second sub-lines are aligned in the first direction as the sheet P is conveyed in the first direction, whereby a second test image G2 is formed. It should be noted that the formation of the first test image G1 and the second test image G2 is instructed through a generation input part 55 of the personal computer 50.

The manufacturer determines the first reference ejection port $H_{L10}$ and the inactive ejection ports $H_{L11}$, $H_{L12}$ based on the first test image G1 and the second test image G2. The determination of the first reference ejection port $H_{L10}$ and the inactive ejection ports $H_{L11}$, $H_{L12}$ is carried out by, for example, visual observation or microscopic observation of the first test image G1 and the second test image G2.

The manufacturer observes the second test image G2 to identify a row of dots formed by the second ejection port $H_{R1}$ defined beforehand as the second reference ejection port in the second head 301B. Then, the manufacturer identifies a row of dots in the first printing area closest in the second direction to the row of dots formed by the second ejection port $H_{R1}$, among the rows of dots in the overlapped area in which the first printing area (i.e., the first test image G1) formed by the first head 301A and the second printing area (i.e., the second test image G2) formed by the second head 301B overlap with each other in the second direction. The manufacturer determines, as the first reference ejection port, the first ejection port $H_L$ forming the row of dots closest in the second direction to the row of dots formed by the second ejection port $H_{R1}$.

With reference to FIG. 7, the manufacturer may identify from the second image G2 a dot row D1 in the first direction, which is formed by the second reference ejection port $H_{R1}$. The manufacturer then identifies from the first test image G1 a dot row closest in the second direction to the dot row D1. In the present embodiment, a dot row D3 extending in the first direction is determined as the dot row closest in the second direction to the dot row D1. The manufacturer determines the first ejection port $H_{L10}$ forming the dot row D3 as the first reference ejection port.

Thereafter, among the first ejection ports $H_{L1}$ to $H_{L12}$, the manufacturer sets the first ejection ports $H_{L11}$, $H_{L12}$ closer to the end part 351A of the first head 301A than the first reference ejection port $H_{L10}$ as the inactive ejection ports. The manufacturer also sets the first ejection ports $H_{L1}$ to $H_{L10}$, excluding the inactive ejection ports $H_{L11}$, $H_{L12}$, and the second ejection ports $H_{R1}$ to $H_{R12}$, as the active ejection ports.

The image forming system 100 is further described with reference to FIGS. 3, 4A and 4B.

The ejection controller 37 controls the ink ejection from the first head 301A and the second head 301B, based on the ejection tables stored in the abovementioned ejection table storage 36. For example, if the ejection tables shown in FIGS. 4A and 4B are stored in the ejection table storage 36, during forming an image, the ejection controller 37 uses the second ejection ports $H_{R2}, \ldots, H_{R11}, H_{R12}$ and the first ejection ports $H_{L1}, \ldots, H_{L9}$ for image formation. The ejection controller 37 uses the second reference ejection port $H_{R1}$ of the second head 301B and the first reference ejection port $H_{L10}$ of the first head 301A alternately every time the ink line is formed for image formation.

As described above, the first head 301A intermittently ejects the ink to form the first sub-lines. The second head 301B intermittently ejects the ink to form the second sub-lines. The ink ejection from the first head 301A delays from the ink ejection from the second head 301B so that the first sub-line is aligned with the second sub-line in the second direction to form an ink row on the sheet P. Thus a main line including the first and second sub-lines aligned in a row in the second direction is formed on the sheet P (see FIGS. 6A and 6B).

In the following description, the dots formed with the ink ejected from the first ejection port $H_{L10}$ defined as the first reference ejection port are called "first dots." The dots formed with the ink ejected from the second ejection port $H_{R1}$ defined as the second reference ejection port are called "second dots."

As described above, the ejection controller 37 uses the second reference ejection port $H_{R1}$ of the second head 301B and the first reference ejection port $H_{L10}$ of the first head 301A alternately every time the line is formed for image formation. Thus, an image formed by the ink ejection from the first head 301A and the ink ejection from the second head 301B includes a first main line with the first dots and a second main line with the second dots, wherein the first main line and the second main line are arrayed alternately in the first direction. It should be noted that the first main line does not include the second dots while the second main line does not include the first dots.

The personal computer 50 includes a controller 51 and an operating part 53. The operating part 53 includes a setting operating part 54 for inputting settings or changes in the ejection tables, and the generation input part 55 for inputting an instruction to generate the test images shown in FIG. 7. Information input to the ejection tables through the setting operating part 54 are exemplified as the ejection port information. The ejection port information includes information on the plurality of first ejection ports $H_L$ and the plurality of second ejection ports $H_R$, information on "active"/"inactive" determined for each of the ejection ports $H_L$, $H_R$, information on the first ejection port $H_{L10}$ used as the first reference ejection port, information on the second ejection port $H_{R1}$ used as the second reference ejection port, and information on the first ejection ports $H_{L11}$, $H_{L12}$ set as the inactive ejection ports. The operating part 53 is exemplified as an input part to which the ejection port information is input. The ejection controller 37 mentioned above is exemplified as a controller configured to control the ink ejection from the first ejection ports $H_L$ and second ejection port $H_R$ based on the ejection port information.

The controller 51 includes a command part 52 configured to provide various instructions to the controller 35 of the image forming apparatus 1. The command part 52 includes elements such as a CPU (Central Processing Unit) configured to execute predetermined arithmetic processing, a ROM (Read Only Memory) configured to store predetermined control programs, and a RAM (Random Access Memory) configured to store data temporarily.

The command part 52 outputs an instruction to store the ejection tables according to the ejection port information input to the setting operating part 54 in the ejection table storage 36, to the controller 35 of the image forming apparatus 1 when the manufacturer inputs the ejection port information for setting the ejection tables through the setting operating part 54. When the manufacturer inputs test image information for generating the test images to the generation input part 55, an instruction to generate the test image is output to the controller 35 from the command part 52. As a result, the controller 35 controls the ejection of the ink such that one of the first printing area (i.e., the first test image G1) and the second printing area (i.e., the second test image G2) is formed on the sheet P and thereafter another printing area is formed in a position shifted in the first direction from the former printing area on the sheet P, as shown in FIG. 7.

In this manner, the ejection tables are stored in the image forming apparatus 1. The image forming apparatus 1 executes an image forming operation based on the ejection tables.

Figure 10:
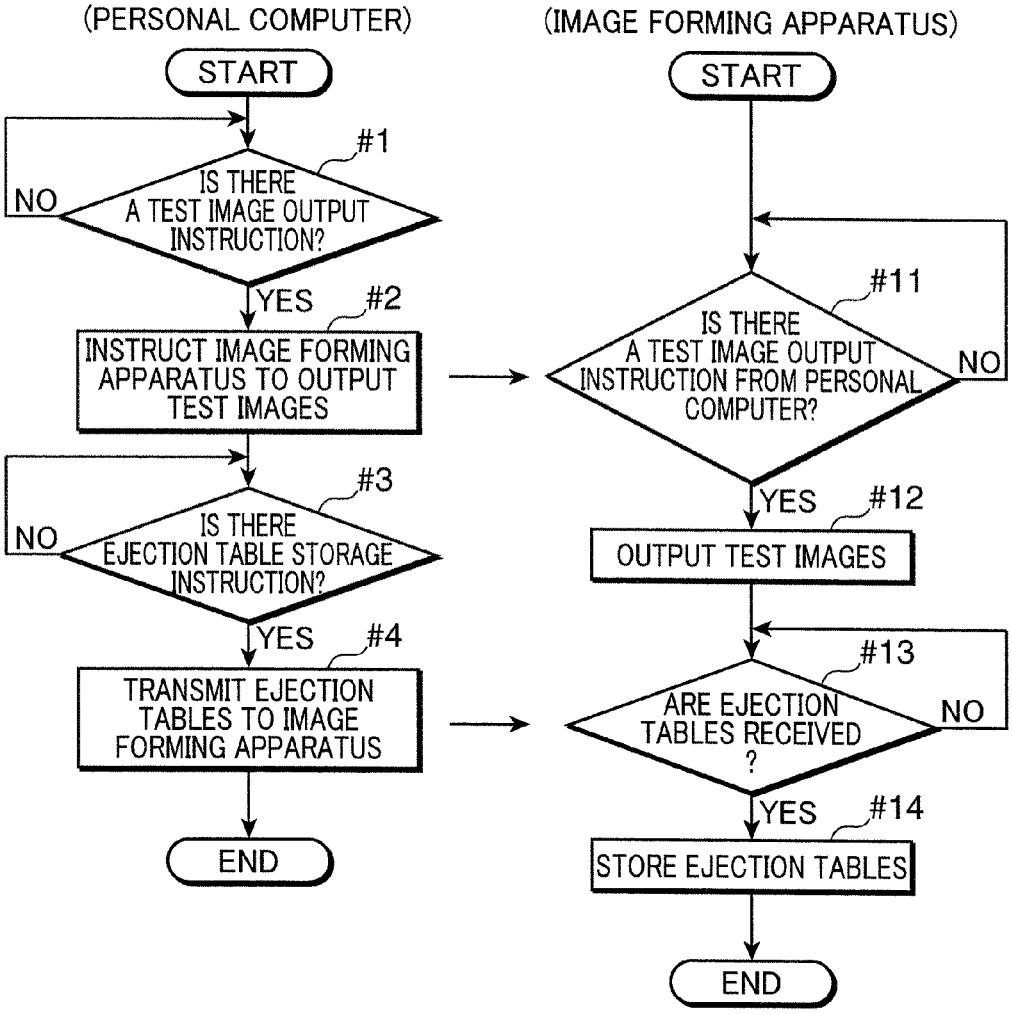
FIG. 10 is a flowchart schematically describing information processing performed by the image forming system.

FIG. 10 is a flowchart showing information processing performed by the image forming system 100. The left diagram in FIG. 10 is a flowchart showing information processing performed by the personal computer 50. The right diagram in FIG. 10 is a flowchart showing information processing performed by the image forming apparatus 1.

As shown in FIG. 10, the command part 52 of the personal computer 50 determines whether the test image information is input to the generation input part 55 (step #1: Yes). When the test image information is input to the generation input part 55, the command part 52 instructs the image forming apparatus 1 to output the test images (step #2).

The controller 51 of the image forming apparatus 1 determines whether or not there is an output instruction about the test images from the command part 52 of the personal computer 50 (step #11). When the output instruction about the test images is input from the command part 52 of the personal computer 50 to the image forming apparatus 1, the controller 35 of the image forming apparatus 1 controls the head unit 30 (and other apparatuses required for forming the test image (for example, the sheet feeder 17)) so that the test images (the first test image G1 and the second test image G2) shown in FIG. 7 are formed (step #12).

The manufacturer determines the first reference ejection port, the inactive ejection ports and the active ejection ports based on the positional relationship in the second direction between the first test image G1 and the second test image G2. The manufacturer uses the information on the determined first reference ejection port, inactive ejection ports and active ejection ports to create (or change) the ejection tables by means of the setting operating part 54 of the personal computer 50.

The command part 52 determines whether or not there is an instruction to store the ejection tables created by the setting operating part 54 (step #3). When the instruction to generate the ejection tables is input (step #3: Yes), the command part 52 transmits the ejection tables to the image forming apparatus 1 (step #4).

The controller 35 of the image forming apparatus 1 determines whether or not the ejection tables are received from the command part 52 of the personal computer 50 (step #13). When the ejection tables are received (step #13: Yes), the ejection tables are then stored in the ejection table storage 36 (step #14).

As described above, the manufacturer may register, in the ejection table storage 36, the information indicating whether each of the first ejection ports $H_L$ formed in the first head 301A and each of the second ejection ports $H_R$ formed in the second head 301B are the active ejection ports that are used for image formation or the inactive ejection ports that are not. The manufacturer may change the records of the registered ejection tables if necessary. At the time of image formation, the heat unit 30 ejects the ink from the first ejection ports $H_L$ and the second ejection ports $H_R$ according to the ejection tables registered in the ejection table storage 36. Thus, it is not necessary to carefully adjust the relative positional relationship between the first head 301A and the second head 301B. According to a conventional technology, a series of operations such as installation of the first head 301A and the second head 301B onto the support 302, microscopic observation of an image formed by the ink ejected from the first head 301A and the second head 301B mounted on the support 302, measurement for the relative positions of the dots in the image and removal/reinstallation of the first head 301A and the second head 301B from/onto the support 302 with readjusting the positional relationship between the first head 301A and the second head 301B have to be repeated until an appropriate positional relationship between the first head 301A and the second head 301B is achieved. In the present embodiment, it is not necessary to repeat the series of operations mentioned above, and so the adjustment of the positional relationship between the first head 301A and the second head 301B may be simplified.

Figure 9A:
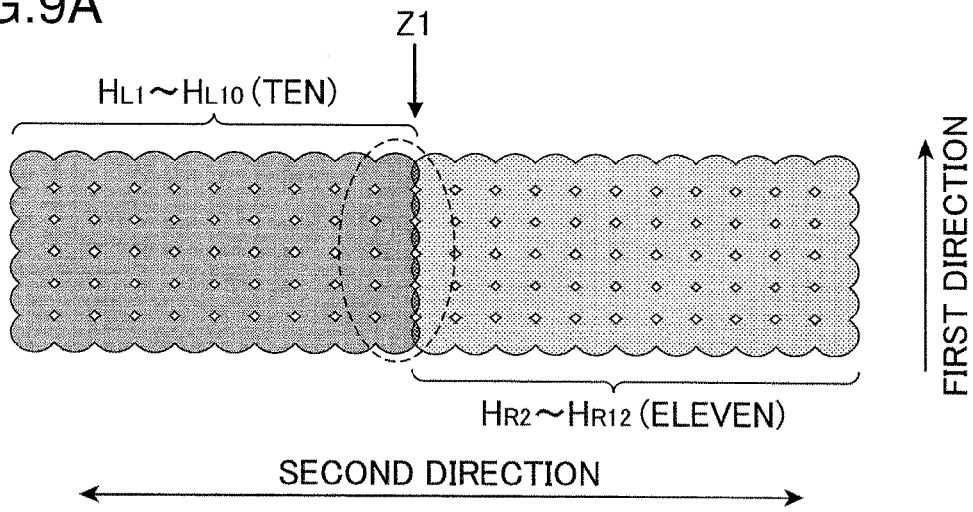
FIG. 9A shows an image formed with one of a first reference ejection port and a second reference ejection port.
Figure 9B:
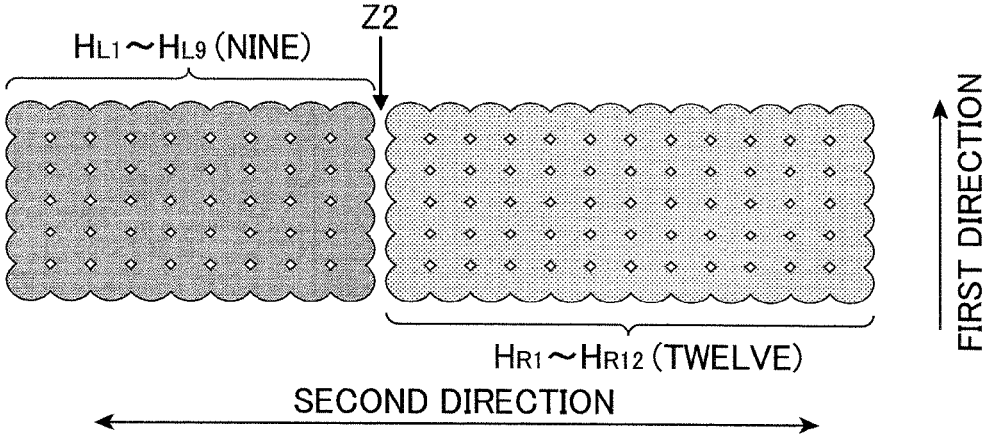
FIG. 9B shows an image formed with one of the first reference ejection port and the second reference ejection port.

The effects of alternate ink ejection between the first reference ejection port and the second reference ejection port are described with reference to FIGS. 6A, 6B, 7, 9A, and 9B. It should be noted that FIG. 9A shows an arrangement of dots obtained when the ink is ejected from the first ejection ports $H_{L1}$ to $H_{L10}$ and the second ejection ports $H_{R2}$ to $H_{R12}$ under the positional relationship between the first head 301A and the second head 301B shown in FIG. 6A. FIG. 9B shows an arrangement of dots obtained when the ink is ejected from the first ejection ports $H_{L1}$ to $H_{L9}$ and the second ejection ports $H_{R2}$ to $H_{R12}$ under the positional relationship between the first head 301A and the second head 301B shown in FIG. 6B.

As shown in FIGS. 6A and 6B, in the present embodiment, the ink ejection from the first reference ejection port and the ink ejection from the second reference ejection port are alternately switched every time the main line extending in the second direction are formed. As a result, compared to the case in which image formation is performed using one of the ejection of ink ejected from the first reference ejection port and the ejection of ink from the second reference ejection port, a high-quality image may be obtained.

As shown in FIG. 7, when the position of the second reference ejection port in the second direction does not completely match the position of the first reference ejection port in the second direction, a space A in the second direction between a dot formed by the ink ejected from the second ejection port $H_{R2}$ defined as the second reference ejection port (the dot in the dot row D1 shown in FIG. 7) and a dot formed by the ink ejected from the first ejection port $H_{L10}$ defined as the first reference ejection port based on the second reference ejection port $H_{R1}$ (the dot in the dot row D3 shown in FIG. 7) often becomes narrower or wider than a space defined by a predetermine resolution. Similarly, a space B in the second direction between a dot formed by the ink ejected from the first ejection port $H_{L11}$ adjacent to the first ejection port $H_{L10}$ defined as the first reference ejection port (the dot in a dot row D2 shown in FIG. 7) and a dot formed by the ink ejected from the second ejection port $H_{R2}$ adjacent to the second ejection port $H_{R1}$ defined as the second reference ejection port (the dot in a dot row D4 shown in FIG. 7) often becomes narrower or wider than the space defined by the predetermined resolution. As a result, the overlapped area of these dots may increases unnecessarily or an undesirable space is formed between these dots.

As shown by the arrow Z1 in FIG. 9A, if the spaces A, B are wider than the space defined by the predetermined resolution and if an image in an overlapping area between the first printing area and the second printing area is formed by the ink ejection with one of the first reference ejection port and the second reference ejection port, an ink colored stripe appears in the image due to the overlapped area of the dots aligned in the first direction.

As shown by the arrow Z2 in FIG. 9B, if the spaces A, B are narrower than the space defined by the predetermined resolution and if an image of an edge of the first printing area or the second printing area is formed by the ink ejection from one of the first reference ejection port and the second reference ejection port, sheet colored stripe appears in the image due to the undesirable space between the dots extending in the first direction.

The ink colored stripe or the sheet colored stripe negatively affects the quality of the image because the stripe is perceived by the user more easily. As shown in FIGS. 6A and 6B, when the ink ejection from the first reference ejection port and the ink ejection from the second reference ejection port are alternately switched every time the main line is formed, preferably the stripe is less likely to occur. Therefore, a high-quality image may be obtained from alternate ink ejection from the first reference ejection port and the second reference ejection port, rather than the ink ejection from one of the first reference ejection port and the second reference ejection port.

Alternatively or optionally, the ink ejection from the first reference ejection port and the ink ejection from the second reference ejection port may be switched whenever a plurality of the main lines are formed. As described above, highly frequent switching between the ink ejection from the first reference ejection port and the ink ejection from the second reference ejection port may be less likely to cause the stripe on the sheet P (for example, the ink ejection from the first reference ejection port and the ink ejection from the second reference ejection port are switched every time the main line is formed).

Figure 8:
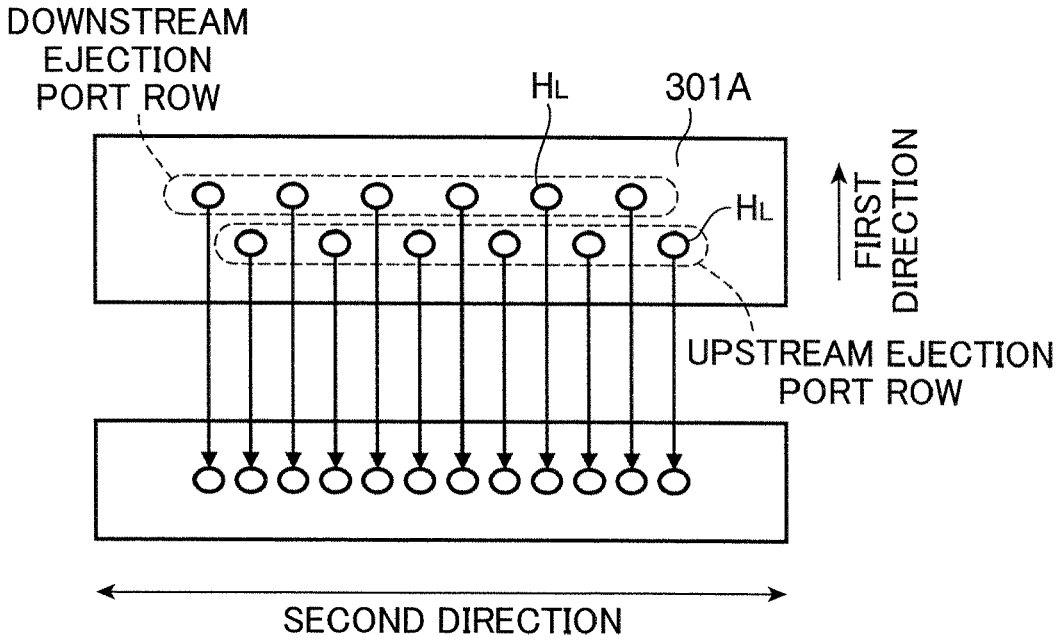
FIG. 8 schematically shows the first head including first ejection ports arranged in a manner of a cross stitch.

FIG. 8 is a schematic bottom view of the first head 301A including the first ejection ports $H_L$ arranged in the form of a cross stitch in the second direction. The cross-stitch arrangement of the first ejection ports $H_L$ shown in FIG. 8 may be applied to the second ejection ports $H_R$ of the second head 301B.

The method for setting the first reference ejection port, the second reference ejection port, the inactive ejection ports, and the active ejection ports is suitably applied to the first head 301A including the first ejection ports $H_L$ arranged in the form of the cross stitch in the second direction and/or the second head 301B including the second ejection ports $H_R$ arranged in the form of the cross stitch in the second direction, in stead of the abovementioned arrangement of the first ejection ports $H_L$ aligned on a straight line extending in the second direction.

The first head 301A shown in the upper diagram of FIG. 8 includes an upstream ejection port row formed on the upstream side and a downstream ejection port row formed on the downstream side. As shown in the lower diagram of FIG. 8, the first ejection ports $H_L$ are arranged in the form of a cross stitch in the second direction such that each of the plurality of first ejection ports $H_L$ of the upstream ejection port row is projected between the first ejection ports $H_L$ of the downstream ejection port row which is projected on the same straight line.

The arrangement of the first ejection ports $H_L$ shown in the lower diagram of FIG. 8 is the same as the arrangement of the first ejection ports $H_L$ shown in FIG. 6A. Therefore, the first reference ejection port, the second reference ejection port, the active ejection ports and the inactive ejection ports are set appropriately for the first ejection ports $H_L$ arranged in the form of the cross stitch and/or the second ejection ports $H_R$ arranged in the form of the cross stitch.

In the embodiment described above, the information on the first reference ejection port, the second reference ejection port, the inactive ejection ports and the active ejection ports are recorded in the ejection tables by the manufacturer. Alternatively, the manufacturer may input only the information on the first reference ejection port and the second reference ejection port to the image forming apparatus 1. In addition, the programs stored in the controller 35 may determine the inactive ejection ports and the active ejection ports on the basis of the input information on the first reference ejection port and the second reference ejection port. Thereafter, the ejection controller 37 may control the head unit 30 in accordance with the input information on the first reference ejection port and the second reference ejection port, as well as the determination made by the programs.

According to the configuration described above, the image forming system ejects the ink onto a sheet conveyed in the first direction. The first head includes a plurality of first ejection ports for ejecting the ink. The second head includes a plurality of second ejection ports for ejecting the ink. The ejection port information on the plurality of first ejection ports and the plurality of second ejection ports are input to the input part. The controller controls the ejection of the ink from the first ejection ports and the second ejection ports, based on the ejection port information. The plurality of first ejection ports and the plurality of second ejection ports are arranged in the second direction intersecting with the first direction. The plurality of first ejection ports defines the first printing area. The plurality of second ejection ports defines the second printing area. The first printing area and the second printing area that overlap with each other in the second direction form the overlapped area. The second head in a shifted position in the first direction with respect to the first head overlaps with the first head in the second direction so that the overlapped area is formed. The plurality of first ejection ports includes the first reference ejection port defining an edge of the overlapped area. The plurality of second ejection ports includes the second reference ejection port defining an edge of the overlapped area. The ejection port information includes information on the first reference ejection port and the second reference ejection port. The controller selectively switches between the ejection of the ink from the first reference ejection port and the ejection of the ink from the second reference ejection port. Thus, the overlapped area composed of the first printing area defined by the first head and the second printing area defined by the second head is adjusted according to the ejection port information including the information on the first reference ejection port and the second reference ejection port. As a result, adjustment of the relative positional relationship between the first head and the second head is simplified.

This application is based on Japanese Patent application serial No. 2009-174576 filed in Japan Patent Office on Jul. 27, 2009, the contents of which are hereby incorporated by reference.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming system configured to eject ink onto a sheet conveyed in a first direction comprising:

a first head including a plurality of first ejection ports configured to eject the ink;

a second head including a plurality of second ejection ports configured to eject the ink and an end part overlapping with the first head;

an input part to which ejection port information on the plurality of first ejection ports and the plurality of second ejection ports is input; and a controller configured to control ejection of the ink from the first ejection ports and the second ejection ports based on the ejection port information, wherein the first head includes an end part overlapping with the second head, the plurality of first ejection ports and the plurality of second ejection ports are aligned in a second direction intersecting with the first direction, the second head in a shifted position in the first direction with respect to the first head is shifted in the second direction with respect to the first head so as to form an overlapped area in which a first printing area defined by the plurality of first ejection ports and a second printing area defined by the plurality of second ejection ports overlap with each other in the second direction, the plurality of first ejection ports include a first reference ejection port defining an edge of the overlapped area, the plurality of second ejection ports include a second reference ejection port defining an edge of the overlapped area, the second reference election port being closest to the end part of the second head among the plurality of second ejection ports, the first reference election port is positioned closest to the second reference ejection port among the plurality of first election ports, the ejection port information includes information for defining a first ejection port between the first reference ejection port and the end part of the first head as inactive ejection port that does not eject the ink, and the controller selectively switches between ejection of the ink from the first reference ejection port and ejection of the ink from the second reference ejection port and causes the ink to be ejected from the plurality of first ejection ports excluding the first ejection port defined as the inactive ejection port.

2. An image forming system configured to eject ink onto a sheet conveyed in a first direction, comprising:

a first head including a plurality of first ejection ports configured to eject the ink;

a second head including a plurality of second ejection ports configured to eject the ink, the second head including an end part overlapping with the first head;

an input part to which ejection port information on the plurality of first election ports and the plurality of second ejection ports is input; and a controller configured to control ejection of the ink from the first ejection ports and the second ejection ports based on the ejection port information, wherein:

the first head includes an end part overlapping with the second head, the plurality of first ejection ports and the plurality of second ejection ports are aligned in a second direction intersecting with the first direction, the second head in a shifted position in the first direction with respect to the first head is shifted in the second direction with respect to the first head so as to form an overlapped area in which a first printing area defined by the plurality of first ejection ports and a second printing area defined by the plurality of second ejection ports overlap with each other in the second direction, the plurality of first ejection ports include a first reference ejection port defining an edge of the overlapped area, the first reference ejection port being closest to the end part of the first head in the plurality of first ejection ports, the plurality of second ejection ports include a second reference ejection port defining an edge of the overlapped area, the second reference ejection port being positioned closest to the first reference ejection port among the plurality of second ejection ports, the ejection port information includes information for defining a second ejection port between the second reference ejection port and the end part of the second head as an inactive ejection port that does not eject the ink, and the controller selectively switches between ejection of the ink from the first reference ejection port and ejection of the ink from the second reference ejection port and causes the ink to be ejected from the plurality of second ejection ports excluding the second ejection port defined as the inactive ejection port.

3. An image forming system configured to eject ink onto a sheet conveyed in a first direction, comprising:

a first head including a plurality of first ejection ports configured to eject the ink;

a second head including a plurality of second ejection ports configured to eject the ink;

an input part to which ejection port information on the plurality of first ejection ports and the plurality of second ejection ports is input; and a controller configured to control ejection of the ink from the first ejection ports and the second ejection ports based on the ejection port information, wherein:

the plurality of first ejection ports and the plurality of second ejection ports are aligned in a second direction intersecting with the first direction, the second head in a shifted position in the first direction with respect to the first head is shifted in the second direction with respect to the first head so as to form an overlapped area in which a first printing area defined by the plurality of first ejection ports and a second printing area defined by the plurality of second ejection ports overlap with each other in the second direction, the plurality of first ejection ports include a first reference ejection port defining an edge of the overlapped area, the plurality of second ejection ports include a second reference ejection port defining an edge of the overlapped area, the ejection port information includes information on the first reference ejection port and the second reference ejection port, a first sub-line including aligned dots formed by the ink ejected from each of the plurality of first ejection ports is formed every time the ink is ejected from the plurality of first ejection ports, a second sub-line including aligned dots formed by the ink ejected from each of the plurality of second ejection ports is formed on the sheet every time the ink is ejected from the plurality of second ejection ports, the controller selectively switches between ejection of the ink from the first reference ejection port and ejection of the ink from the second reference ejection port and controls the ejection of the ink from the plurality of first ejection ports and the ejection of the ink from the plurality of second ejection ports in accordance with a conveyance of the sheet so as to form a main line in which the first sub-line and the second sub-line are arrayed in one row in the second direction, and the main line includes a first main line with a first dot formed by the ink ejected from the first reference ejection port and a second main line with a second dot formed by the ink ejected from the second reference ejection port, the first main line excludes the second dot, the second main line excludes the first dot, and the controller controls the ejection of the ink such that the first main line and the second main line are arranged alternately in the first direction.

4. An image forming system configured to eject ink onto a sheet conveyed in a first direction comprising:

a first head including a plurality of first ejection ports configured to eject the ink;

a second head including a plurality of second ejection ports configured to eject the ink;

an input part to which ejection port information on the plurality of first ejection ports and the plurality of second ejection ports is input; and a controller configured to control ejection of the ink from the first ejection ports and the second ejection ports based on the ejection port information, wherein:

the plurality of first ejection ports and the plurality of second ejection ports are aligned in a second direction intersecting with the first direction, the second head in a shifted position in the first direction with respect to the first head is shifted in the second direction with respect to the first head so as to form an overlapped area in which a first printing area defined by the plurality of first ejection ports and a second printing area defined by the plurality of second ejection ports overlap with each other in the second direction, the plurality of first ejection ports include a first reference ejection port defining an edge of the overlapped area, the plurality of second ejection ports include a second reference ejection port defining an edge of the overlapped area, the ejection port information includes information on the first reference ejection port and the second reference ejection port, the input part is configured to receive an input of test image information for forming a test image on the sheet, and the controller selectively switches between ejection of the ink from the first reference ejection port and ejection of the ink from the second reference ejection port and controls the ejection of the ink based on the test image information, such that one of the first printing area and the second printing area is formed on the sheet and thereafter another printing area is formed in a position shifted in the first direction in relation to the former printing area.

5. The image forming system according to claim 1, wherein the plurality of first ejection ports is arranged along a straight line extending in the second direction.

6. The image forming system according to claim 1, wherein the plurality of second ejection ports is arranged along a straight line extending in the second direction.

7. The image forming system according to claim 1, wherein the plurality of first ejection ports is arranged in a manner of a cross stitch along the second direction.

8. The image forming system according to claim 1, wherein the plurality of second ejection ports is arranged in a manner of a cross stitch along the second direction.

9. The image forming system according to claim 1, further comprising a storage configured to store the ejection port information.

10. The image forming system according to claim 3, further comprising:

a conveying part configured to convey the sheet in the first direction, wherein the controller shifts a timing of the ejection of the ink from the plurality of first ejection ports with respect to a timing of the ejection of the ink from the plurality of second ejection ports in accordance with a distance in the first direction between the plurality of first ejection ports and the plurality of second ejection ports as well as a speed of conveying the sheet conveyed by the conveying part.

* * * * *